US010866023B2

(12) United States Patent
Park et al.

(10) Patent No.: US 10,866,023 B2
(45) Date of Patent: Dec. 15, 2020

(54) ADIABATIC COLLECTOR FOR RECYCLING GAS, LIQUEFIER FOR RECYCLING GAS, AND RECOVERY APPARATUS FOR RECYCLING GAS USING SAME

(71) Applicant: Korea Basic Science Institute, Daejeon (KR)

(72) Inventors: Seung Young Park, Daejeon (KR); Yeon Suk Choi, Daejeon (KR)

(73) Assignee: KOREA BASIC SCIENCE INSTITUTE, Daejeon (KR)

( * ) Notice: Subject to any disclaimer, the term of this patent is extended or adjusted under 35 U.S.C. 154(b) by 1 day.

(21) Appl. No.: 16/239,239

(22) Filed: Jan. 3, 2019

(65) Prior Publication Data

US 2019/0137175 A1 May 9, 2019

Related U.S. Application Data

(62) Division of application No. 15/034,250, filed as application No. PCT/KR2013/010214 on Nov. 12, 2013.

(30) Foreign Application Priority Data

Nov. 6, 2013 (KR) ..... 10-2013-0134159

(51) Int. Cl.
*F25J 3/04* (2006.01)
*F25D 19/00* (2006.01)

(52) U.S. Cl.
CPC ..... *F25J 3/04412* (2013.01); *F25D 19/00* (2013.01)

(58) Field of Classification Search
CPC ..... F04B 56/10; F04B 19/006; F04B 19/24; F04F 1/04; F04F 1/18; F25J 3/04412; F25B 2309/1408; F25B 2400/17; F17C 3/10; F17C 3/0631; F17C 3/0626; F17C 3/0391; F17C 2227/0341; F17C 2227/0386
See application file for complete search history.

(56) References Cited

U.S. PATENT DOCUMENTS 1,960,975 A * 5/1934 Mulch ..... B01D 35/18 62/319
2,863,297 A * 12/1958 Johnston ..... F17C 3/08 62/45.1
2010/0192568 A1* 8/2010 Peacock ..... F04B 19/24 60/531

FOREIGN PATENT DOCUMENTS

JP 08-327171 A 12/1996
JP 10-245208 A 9/1998
(Continued)

*Primary Examiner* — Frantz F Jules
*Assistant Examiner* — Webeshet Mengesha
(74) *Attorney, Agent, or Firm* — Dentons US LLP

(57) ABSTRACT

Disclosed is an adiabatic collector for recycling gas, a liquefier for recycling gas, and a recovery apparatus for recycling gas using the same. More specifically, gas to be recycled is collected in an adiabatic manner, cooled to a temperature lower than the dew point thereof, and stored in the liquid state through a phase change, thereby saving energy required for re-cooling the gas. Particularly, the present invention relates to an adiabatic collector for recycling gas, a liquefier for recycling gas, and a recovery apparatus for recycling gas using the same, in which recycling gas is compressed through a natural inducement method using a difference in temperature and pressure while being collected and liquefied, thereby reducing noise, vibration, and size of the collector.

7 Claims, 12 Drawing Sheets

(56) References Cited

FOREIGN PATENT DOCUMENTS

| | | | | | |
|---|---|---|---|---|---|
| JP | 2002089983 | | * | 9/2000 | ..... F25B 2309/1408 |
| JP | 2002-089983 | A | | 3/2002 | |
| JP | 2002089983 | | * | 3/2002 | |
| JP | 2006-046896 | A | | 2/2006 | |
| KR | 10-0662189 | B1 | | 12/2006 | |

* cited by examiner

ADIABATIC COLLECTOR FOR RECYCLING GAS, LIQUEFIER FOR RECYCLING GAS, AND RECOVERY APPARATUS FOR RECYCLING GAS USING SAME

RELATED APPLICATION DATA

This application is a divisional of U.S. patent application Ser. No. 15/034,250, filed May 4, 2016, the entirety of which is incorporated herein by reference to the extent permitted by law. U.S. patent application Ser. No. 15/034,250 is the Section 371 National Stage of PCT/KR2013/010214 filed Nov. 12, 2013. This application claims the benefit of priority to Korean Patent Application No. 10-2013-0134159 filed Nov. 6, 2013.

TECHNICAL FIELD

The present invention relates generally to an adiabatic collector for recycling gas, a liquefier for recycling gas, and a recovery apparatus for recycling gas using the same. More specifically, gas to be recycled is collected in an adiabatic manner, cooled to a temperature lower than the dew point thereof, and stored in a liquid state through a phase change, thereby saving energy required for re-cooling the gas.

Particularly, the present invention relates to an adiabatic collector for recycling gas, a liquefier for recycling gas, and a recovery apparatus for recycling gas using the same, in which recycling gas is compressed through a natural inducement method using a difference in temperature and pressure while being collected and liquefied, thereby reducing noise, vibration, and size of the system.

BACKGROUND ART

Recently, for precise measurement, a nuclear magnetic resonance apparatus, a mass spectrometer, or an electron microscope for measuring a sample measures the sample in a cryogenic state using cryogenic refrigerant, such as liquid helium or liquid nitrogen.

The cryogenic refrigerant is problematic in that in the process of waiting for re-condensation after cooling a sample, the temperature of the cryogenic refrigerant rises, and vaporizes into refrigerant gas, and also much energy is required in the process of cooling for re-condensation.

FIG. 1 is a view illustrating a conventional collecting and liquefying system for gas.

As shown in FIG. 1, the conventional system includes: a gas tank 1 for collecting refrigerant gas; a compressor 2 for compressing the refrigerant gas in the gas tank 1; a purifier 3 for removing impurities in the refrigerant gas; a liquefying tank 4 for storing the refrigerant gas in a liquid state; a condenser 5 for liquefying the refrigerant gas flowing into the liquefying tank 4 after cooling the refrigerant gas by using a cold finger 5*a*; a compressor 6 for supplying refrigerant to the condenser 5; and a chiller 7 for cooling the compressor 6.

The conventional system is configured such that the refrigerant gas in a cryogenic state is collected in the gas tank 1, is compressed by the compressor 2 after long wait, and then is supplied to the liquefying tank 4 via the purifier 3.

However, the conventional system is problematic in that the gas tank 1 simply stores the refrigerant gas without insulation, whereby the temperature of the refrigerant gas in the cryogenic state rises. For this reason, the condenser 5 consumes much energy to cool the room temperature refrigerant gas to cool the cryogenic refrigerant gas for liquefying.

The conventional system is further problematic in that the compressor 2 for compressing the refrigerant gas in the gas tank 1 is a mechanical type, thereby generating noise and vibration, and also increasing the temperature rise of the refrigerant gas.

Herein, the conventional system uses a conventional mechanical compressor 2, which may be easily damaged when compressing the cryogenic refrigerant gas. The conventional system uses a mechanical compressor for the expensive cryogenic refrigerant, and is thus disadvantageous in terms of improving economic efficiency.

Meanwhile, as a document of related art of the present invention, Korean Patent No. 10-0662189 discloses "Refrigerant gas recycling apparatus for cryogenic cooling device".

The refrigerant gas recycling apparatus for cryogenic cooling device includes: a first gas container 30 for temporarily storing refrigerant gas in a gas state; a compressor 40 for compressing the refrigerant gas; and a second gas container 50 for storing the compressed refrigerant gas and for supplying the compressed refrigerant gas to the cryogenic cooling device 10, wherein the first gas container 30 is provided with a heater 12 rather than elements for insulating the container, thereby failing to keep the refrigerant gas in the cryogenic state.

Further, the compressor 40 is a mechanical type, and thereby generates vibration and noise.

DISCLOSURE

Technical Problem

Accordingly, the present invention has been made keeping in mind the above problems occurring in the related art, and the present invention is intended to propose an adiabatic collector for recycling gas, a liquefier for recycling gas, and a recovery apparatus for recycling gas using the same, the collector being capable of preventing a temperature rise of a recycling gas in a cryogenic state, such as cryogenic refrigerant gas, which is used by being re-cooled, thereby saving energy required for re-cooling the recycling gas.

The present invention is further intended to propose an adiabatic collector for recycling gas, a liquefier for recycling gas, and a recovery apparatus for recycling gas using the same configured such that recycling gas is compressed through a natural inducement method using a difference in temperature and supplied, thereby reducing noise, vibration, and size of the system compared to a system that uses a mechanical compressor.

The present invention is further intended to propose a recovery apparatus for recycling gas and is configured such that a collector for collecting recycling gas and a liquefier for liquefying recycling gas are movable, whereby a gas transfer line provided in the conventional system may not be required.

Technical Solution

In order to achieve the above object, according to one aspect of the present invention, there is provided an adiabatic collector for recycling gas, the collector including: a buffer container being detachably connected to a recycling gas generation line, storing the recycling gas, and buffering a pressure of the recycling gas and then discharging the recycling gas; a first non-mechanical (NM) compressor for non-mechanically compressing the recycling gas discharged from the buffer container by using a pressure difference caused by thermal expansion of the recycling gas, and then supplying the recycling gas; and an adiabatic gas container being communicatively connected to the first NM compressor for storing the recycling gas in an adiabatic state, wherein the adiabatic gas container includes: a gas tank providing a storage space for storing the recycling gas by being communicatively connected to the first NM compressor, and being provided with a discharge valve so as to discharge the stored recycling gas; a first vacuum jacket forming a vacuum space along an outer surface of the gas tank; a refrigerant jacket forming a cooling space along an outer surface of the first vacuum jacket so as to allow refrigerant to flow through the refrigerant jacket; a second vacuum jacket forming a vacuum space along an outer surface of the refrigerant jacket; and a vacuum pump communicatively connected both to the gas tank and to the first and second vacuum jackets so as to respectively create a vacuum in the storage space of the gas tank and in each of the vacuum jackets.

The adiabatic gas container may further include an intake valve for cooling the first vacuum jacket by using the refrigerant flowing through the refrigerant jacket by supplying the first vacuum jacket with air or with the refrigerant in a state where the intake valve penetrates through both the second vacuum jacket and the refrigerant jacket.

The adiabatic gas container may yet further include: a pressure sensor for sensing an internal pressure of the storage space of the gas tank; and a safety valve communicatively connected to the gas tank, configured to be opened by a sensing signal of the pressure sensor, and discharging the recycling gas from the storage space to an outside.

For example, the first NM compressor may include: an expansion chamber that is supplied with the recycling gas discharged from the buffer container, changes the supplied recycling gas into high pressure recycling gas by supplying thermal energy thereto, and provides an expansion space for the recycling gas; a discharge valve openably provided in an outlet of the expansion chamber so as to be connected to the adiabatic gas container, and discharging the high pressure recycling gas into the adiabatic gas container by using the pressure difference as the recycling gas in the expansion chamber expands to have a high pressure; and an inflow valve openably provided in an inlet of the expansion chamber so as to be connected to the buffer container, wherein the inflow valve is configured such that as the high pressure recycling gas is discharged through the discharge valve, an internal pressure of the expansion chamber is changed into a low pressure, thereby allowing the recycling gas in the buffer container to flow into the expansion chamber by using the pressure difference.

Meanwhile, a liquefier for recycling gas according to the present invention includes: a second non-mechanical (NM) compressor supplied with recycling gas in an adiabatic state, non-mechanically compressing the recycling gas by using a pressure difference caused by thermal expansion of the recycling gas, and then supplying the recycling gas; a container-shaped dewar that is communicatively connected to the second NM compressor, provides a storage space for storing the recycling gas in a liquid state, and has an opening provided at a side of the dewar so as to discharge the recycling gas in the liquid state through the opening; a cold finger provided in the storage space by protruding after penetrating the dewar, and liquefying the recycling gas by coming into contact with the recycling gas supplied from the second NM compressor in a cryogenic state; a refrigerator for cooling the cold finger into a cryogenic state; a compressor for supplying refrigerant to the refrigerator; and a chiller for cooling the compressor, wherein the second NM compressor includes: an expansion chamber supplied with the recycling gas in the adiabatic state, changing the supplied recycling gas into high pressure recycling gas by supplying thermal energy thereto, and providing an expansion space for the recycling gas; a discharge valve openably provided in an outlet of the expansion chamber so as to be connected to the dewar, and discharging the high pressure recycling gas into the dewar by using the pressure difference as the recycling gas in the expansion chamber expands to cause a high pressure; and an inflow valve openably provided in an inlet of the expansion chamber so as to allow the recycling gas to flow into the expansion chamber, wherein the inflow valve is configured such that as the high pressure recycling gas is discharged through the discharge valve, an internal pressure of the expansion chamber is changed into a low pressure, thereby allowing the recycling gas in the buffer container to flow into the expansion chamber by using the pressure difference.

For example, the dewar may include: a liquefying tank forming the storage space; a first vacuum jacket forming a vacuum space along an outer surface of the liquefying tank so as to prevent heat loss from the liquefying tank; a refrigerant jacket forming a cooling space along an outer surface of the first vacuum jacket so as to allow refrigerant to flow through the refrigerant jacket; and a second vacuum jacket forming a vacuum space along an outer surface of the refrigerant jacket so as to prevent heat loss from the refrigerant jacket.

The dewar may further include a purification jacket forming a flow passage between the refrigerant jacket and the second vacuum jacket, wherein the purification jacket is configured such that a first end thereof communicates with the second NM compressor and a second end thereof communicates with the liquefying tank; and the purification jacket pre-cools the recycling gas by using cold of the refrigerant jacket while detouring the recycling gas in the second NM compressor along the outer surface of the refrigerant jacket, and condenses impurities in the recycling gas.

The dewar may yet further include a drain valve provided at a lower portion of the purification jacket so as to drain the impurities condensed by the cold of the refrigerant jacket.

The dewar may yet further include a refrigerant supply line for cooling the expansion chamber to a low temperature by supplying a part of the refrigerant flowing out from the refrigerant jacket in a state of being processed by heat exchange between the refrigerant and the recycling gas flowing through the purification jacket, along an outer surface of the expansion chamber of the second NM compressor.

The dewar may yet further include a compressor cooling line for cooling the compressor by using the refrigerant by supplying the refrigerant discharged from the refrigerant supply line after cooling the expansion chamber, to the compressor.

The dewar may yet further include a selector provided in the refrigerant supply line, wherein the selector supplies the refrigerant at a low temperature discharged from the refrigerant jacket to the expansion chamber or supplies the refrigerant at a high temperature discharged from the compressor cooling line to the expansion chamber.

For example, the selector may include a three-way valve openably provided in the refrigerant supply line, wherein the three-way valve cools the expansion chamber by communicating the refrigerant jacket with the outer surface of the expansion chamber, or heats the expansion chamber by communicating the compressor cooling line with the outer surface of the expansion chamber.

The dewar may still yet further include: a transfer line inserted into the storage space of the liquefying tank through the opening and discharging the recycling gas in the liquid state stored in the liquefying tank to the outside; and a contact-type precooler being in contact with the refrigerant jacket at a first end thereof, and being in contact with the transfer line at a second end thereof by protruding in the storage space, thereby pre-cooling the transfer line by using cold of the refrigerant jacket.

Meanwhile, a recovery apparatus for recycling gas according to the present invention is provided, the apparatus includes: an adiabatic collector collecting recycling gas generated from the recycling gas-generation line in an adiabatic manner; and the liquefier, detachably connected to the adiabatic collector, and non-mechanically compressing the recycling gas supplied from the adiabatic collector and liquefying the recycling gas into a liquid state.

Further, the adiabatic collector and the liquefier may be configured to be individually carried by being mounted to respective movable carriers, and to be detachably connected to each other.

Advantageous Effects

The adiabatic collector for recycling gas, the liquefier for recycling gas, and the recovery apparatus for recycling gas using the same according to the present invention having the above-described characteristics, makes it possible to minimize energy consumption because the recycling gas is collected in an adiabatic manner by the adiabatic collector, is supplied to the liquefier, and is liquefied, thereby preventing a temperature rise of the recycling gas.

Further, the present invention is configured such that the compressors that compress the recycling gas for collecting and liquefying the recycling gas are non-mechanical types that compress the recycling gas through a natural inducement method. Thus, it is possible to prevent vibration and noise, and is possible to miniaturize equipment, thereby it is possible to produce a system in various shapes and sizes.

Further, the adiabatic collector and the liquefier may be configured to be individually carried by being mounted to respective movable carriers, and to be detachably connected to each other, whereby the transfer line provided in the conventional system may not be required. Thus, it is possible to reduce equipment costs.

BEST MODE

Reference will now be made in greater detail to an exemplary embodiment of the present invention, an example of which is illustrated in the accompanying drawings. In the following description of the present invention, detailed descriptions of known functions and components incorporated herein will be omitted.

Figure 1:
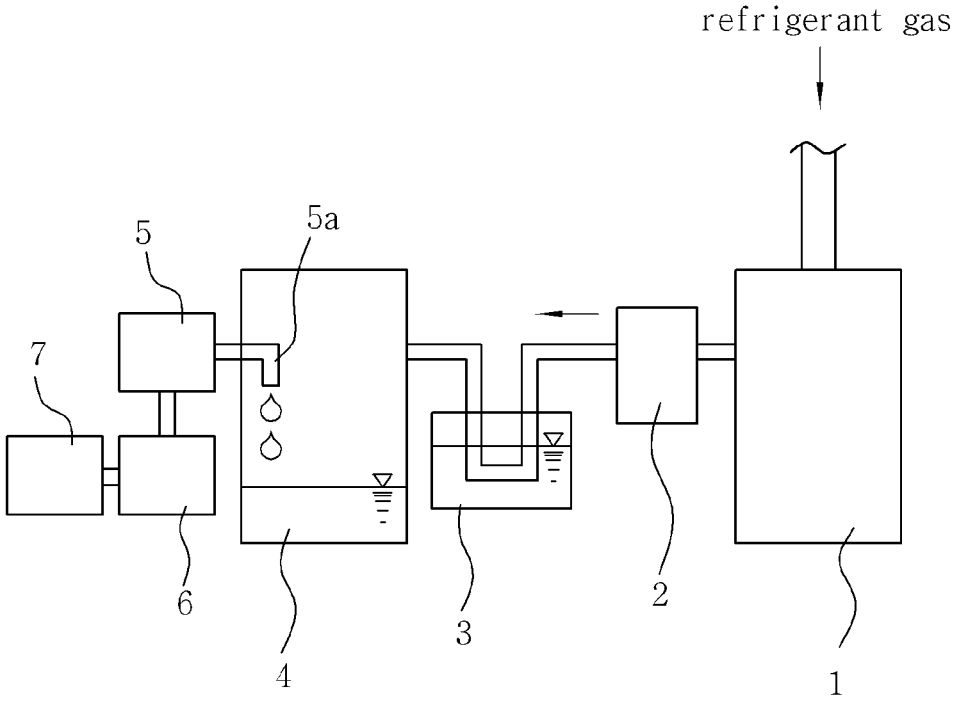
FIG. 1 is a view illustrating a conventional collecting and liquefying system for gas.
Figure 2:
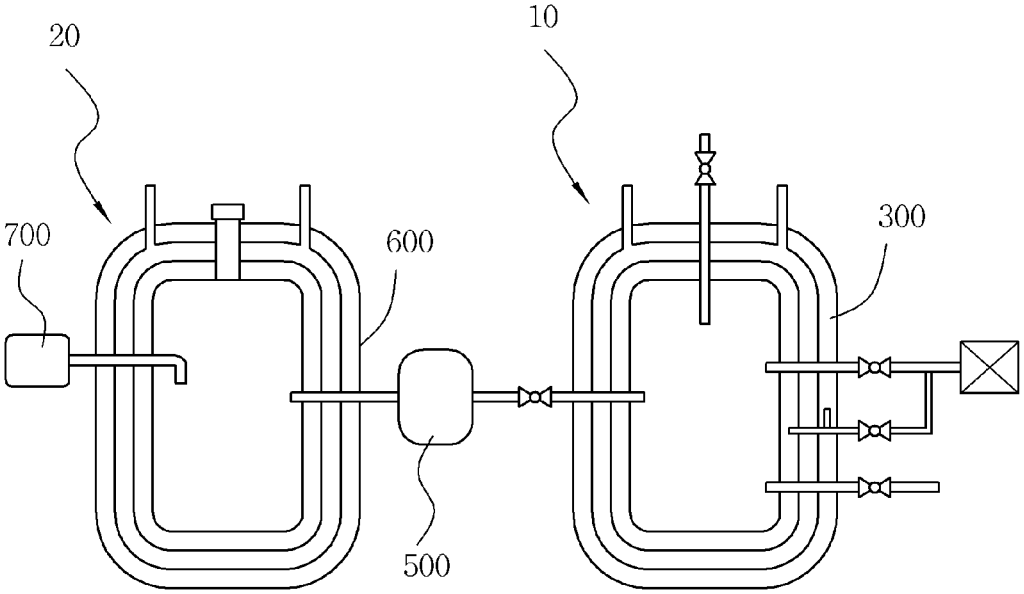
FIG. 2 is a view illustrating a configuration of a recovery apparatus for recycling gas according to the present invention.

As shown in FIG. 2, a recovery apparatus for recycling gas according to the present invention includes an adiabatic collector 10 and a liquefier 20.

Herein, helium gas or nitrogen gas used as cryogenic refrigerant may be an example of the recycling gas.

The adiabatic collector 10 is detachably connected to a recycling gas-generation line or to a system for generating recycling gas, and serves to collect the recycling gas in an adiabatic manner by preventing a temperature rise thereof.

Figure 3:
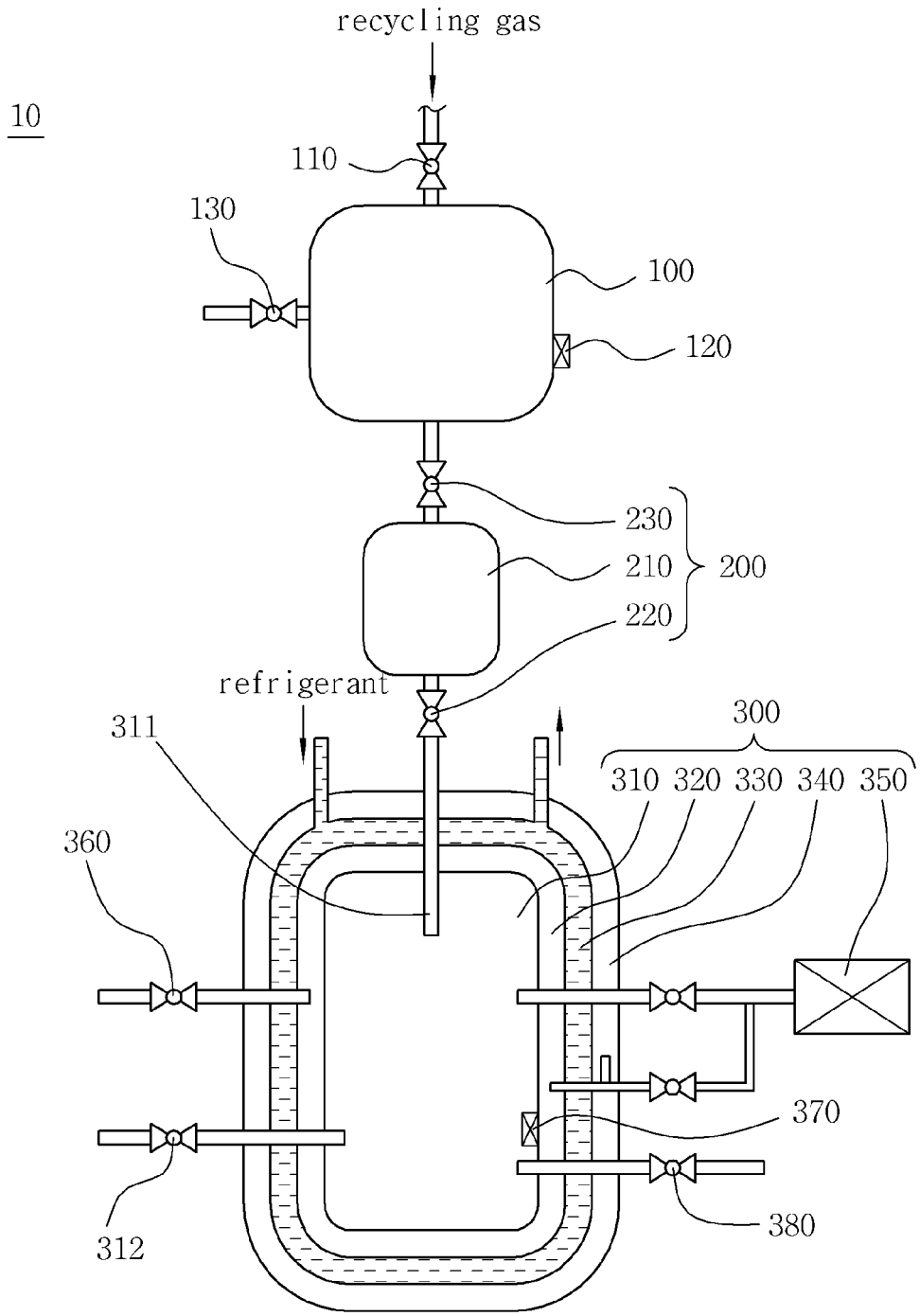
FIG. 3 is a view illustrating a configuration of an adiabatic collector shown in FIG. 2.

As shown in FIG. 3, the adiabatic collector 10 may include a buffer container 100, a first non-mechanical (NM) compressor 200, and an adiabatic gas container 300.

The buffer container 100 is detachably connected to the recycling gas-generation line, which is not shown in the drawings, temporarily stores the recycling gas, and buffers a pressure of the recycling gas.

The buffer container 100 includes: a control valve 110 for controlling inflow of the recycling gas; a pressure sensor 120 for sensing a charging pressure of the recycling gas; and a safety valve 130 provided at a side of the buffer container, and discharging the recycling gas when the recycling gas is overcharged.

The first NM compressor 200, as a non-mechanical heat compressor, serves to compress the recycling gas supplied from the buffer container 100 through a natural inducement method by using a pressure difference caused by thermal expansion of the recycling gas, and then to supply the recycling gas.

As shown in FIG. 3, the first NM compressor 200 may include an expansion chamber 210, a discharge valve 220, and an inflow valve 230.

The expansion chamber 210 serves to provide a space for the thermal expansion of the recycling gas, wherein the expansion chamber is configured such that the recycling gas is stored therein at predetermined capacity by being connected to the buffer container 100. Further, the expansion chamber changes the recycling gas into high temperature and high pressure recycling gas by supplying thermal energy thereto, and then discharges the recycling gas; and the expansion chamber is changed to have a low temperature and low pressure by discharging the recycling gas, thereby allowing the recycling gas in the buffer container 100 to flow thereinto.

The expansion chamber 210 may be provided with a heater, which is not shown in the drawings, for expanding the recycling gas by heat. Alternatively, the recycling gas may be expanded using a fluid having a higher dew point than that of the recycling gas.

In other words, the recycling gas is expanded to cause a high pressure within the expansion chamber 210.

As shown in FIG. 3, a discharge valve 220 is openably provided in an outlet of the expansion chamber 210 so as to be connected to the adiabatic gas container 300, and serves to discharge the high pressure recycling gas into the adiabatic gas container. Herein, it is preferred that the discharge valve 220 is a check valve that allows the recycling gas to flow therethrough in one direction.

The discharge valve 220 is configured to be closed as the recycling gas flows into the expansion chamber 210, and is configured to be opened as the recycling gas of the expansion chamber 210 expands to have a high pressure such that the high pressure recycling gas is supplied to the adiabatic gas container 300.

As shown in FIG. 3, an inflow valve 230 is openably provided in an inlet of the expansion chamber 210 so as to control inflow of the recycling gas. For example, it is preferred that the inflow valve 230 is a check valve that allows the recycling gas to flow therethrough in one direction.

The inflow valve 230 is configured to be opened by a negative pressure in the expansion chamber 210 generated when the discharge valve 220 discharges the high pressure recycling gas such that the recycling gas flows into the expansion chamber, and configured to be closed after the recycling gas flows into the expansion chamber.

In other words, the discharge valve 220 is configured to be opened by the high pressure in the expansion chamber 210 caused by the expansion of the recycling gas so as to discharge the recycling gas; and the inflow valve 230 is configured to be opened by the negative pressure in the expansion chamber 210 caused by discharging the recycling gas so as to allow the recycling gas to flow into the expansion chamber.

Consequently, the recycling gas is compressed in the expansion chamber 210 by a pressure difference caused by thermal expansion thereof, and then is supplied to the adiabatic gas container 300 through a natural inducement method.

Thus, the adiabatic collector 10 according to the present invention non-mechanically compresses the recycling gas via the first NM compressor 200, and thereby has less noise, less vibration, and a smaller compressor than a system using a mechanical compressor.

The adiabatic gas container 300 serves to store the recycling gas supplied from the first NM compressor 200 in an adiabatic manner. For example, as shown in FIG. 3, the adiabatic gas container 300 may include a gas tank 310, a first vacuum jacket 320, a refrigerant jacket 330, a second vacuum jacket 340, and a vacuum pump 350.

The gas tank 310 provides a storage space for storing the recycling gas supplied from the first NM compressor 200 through an inflow pipe 311, and is provided with a discharge valve 312 so as to discharge the stored recycling gas to the liquefier 20, which will be described hereinbelow.

As shown in FIG. 3, the gas tank 310 is connected to the vacuum pump 350 such that the recycling gas flows into and stored in the gas tank in a vacuum state by being supplied with the negative pressure.

Meanwhile, the gas tank 310 is provided with a pressure sensor 370 and a safety valve 380 so as to sense a storage pressure of the recycling gas via the pressure sensor 370, and to discharge the recycling gas through the safety valve 380 provided on a side of the gas tank when the recycling gas is overly stored or when the pressure of the recycling gas rises due to a temperature rise of the storage space.

Herein, the safety valve 380 may be configured to be connected to another gas tank so as to store the recycling gas therein. In other words, a plurality of gas tanks may be connected in series or in parallel and may sequentially store the recycling gas.

As shown in FIG. 3, the first vacuum jacket 320 forms a vacuum space along an outer surface of the gas tank 310 so as to insulate the gas tank 310 from the heat. The first vacuum jacket 320, as shown in FIG. 3, is formed to have a vacuum by being connected to the vacuum pump 350.

The refrigerant jacket 330 forms a cooling space along an outer surface of the first vacuum jacket 320 so as to allow refrigerant to flow through the refrigerant jacket, thereby cooling the recycling gas stored in the gas tank 310. Herein, it is preferred that the refrigerant flowing through the refrigerant jacket 330 is liquid nitrogen.

Herein, as shown in FIG. 3, the refrigerant jacket 330 also functions to cool the recycling gas flowing into the inflow pipe 311 by being in contact with the inflow pipe 311, into which the recycling gas flows.

As shown in FIG. 3, the second vacuum jacket 340 forms a vacuum space along an outer surface of the refrigerant jacket 330 so as to insulate the refrigerant jacket 330 from the heat. The second vacuum jacket 340, as shown in FIG. 3, is formed with a vacuum by being connected to the vacuum pump 350.

Consequently, the gas tank 310 is cooled by the refrigerant jacket 330 and insulated by both the first vacuum jacket 310 and the second vacuum jacket 340, thereby being kept adiabatic. Thus, the gas tank is capable of storing the recycling gas in a cryogenic state.

Meanwhile, as shown in FIG. 3, the adiabatic gas container 300 may be provided with an intake valve 360 communicating with the first vacuum jacket 320 such that air or the refrigerant is charged into the first vacuum jacket 320 through the intake valve 360.

For example, when the adiabatic gas container 300 stores the recycling gas, which has a higher temperature than that of the refrigerant (liquid nitrogen) flowing through the refrigerant jacket 330, in the gas tank 310 at the same level of temperature as the refrigerant, it is preferred that the first vacuum jacket 320 is cooled by injecting air or the refrigerant through the intake valve 360.

On the other hand, when the adiabatic gas container 300 stores the recycling gas, which has a higher temperature than that of the refrigerant (liquid nitrogen), in the gas tank 310, it is preferred that a vacuum is formed in the first vacuum jacket 320 by closing the intake valve 360.

As described above, the adiabatic collector 10 according to the present invention is configured to store the recycling gas in an adiabatic manner, thereby supplying the recycling gas in the cryogenic state to the liquefier 20, and thus it is possible to save energy required for liquefying the recycling gas.

Further, the adiabatic collector 10 according to the present invention is configured to compress the recycling gas via the first NM compressor 200 through a natural inducement method and then supply the recycling gas to adiabatic gas container 300, thereby reducing noise, and vibration.

As shown in FIG. 2, the liquefier 20 is detachably connected to the adiabatic collector 10, and serves to non-mechanically compress the recycling gas supplied from the adiabatic collector 10 and to liquefy and store the recycling gas therein in a liquid state.

Figure 4:
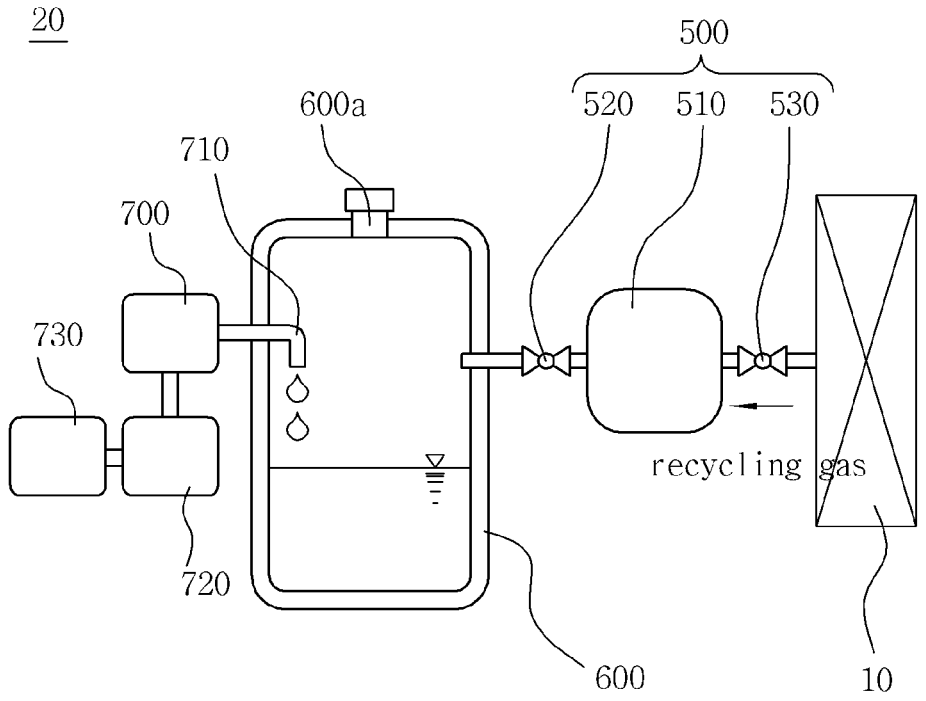
FIG. 4 is a view illustrating a configuration of a liquefier shown in FIG. 2.

For example, the liquefier 20, as shown in FIG. 4, may include a second NM compressor 500, a dewar 600, a cold finger 710, a refrigerator 700, a compressor 720, and a chiller 730.

The second NM compressor 500 is detachably connected to the discharge valve 312 of the adiabatic collector 10, makes the recycling gas thermally expand, compressing the recycling gas through a natural inducement method by using the pressure difference, and then supplies the recycling gas.

In other words, as shown in FIG. 3, the second NM compressor 500, similar to the first NM compressor 200, may include: an expansion chamber 510 providing a space for the thermal expansion of the recycling gas; a discharge valve 520 discharging the high pressure recycling gas; and an inflow valve 530 allowing the recycling gas to flow into the expansion chamber by a negative pressure of the expansion chamber 510, of which an internal pressure is changed into a low pressure by discharging the recycling gas.

Herein, functions and constructions relating to the second NM compressor 500 will be omitted because it has the same functions and construction as the first NM compressor 200, which has been described hereinbefore.

Figure 11:
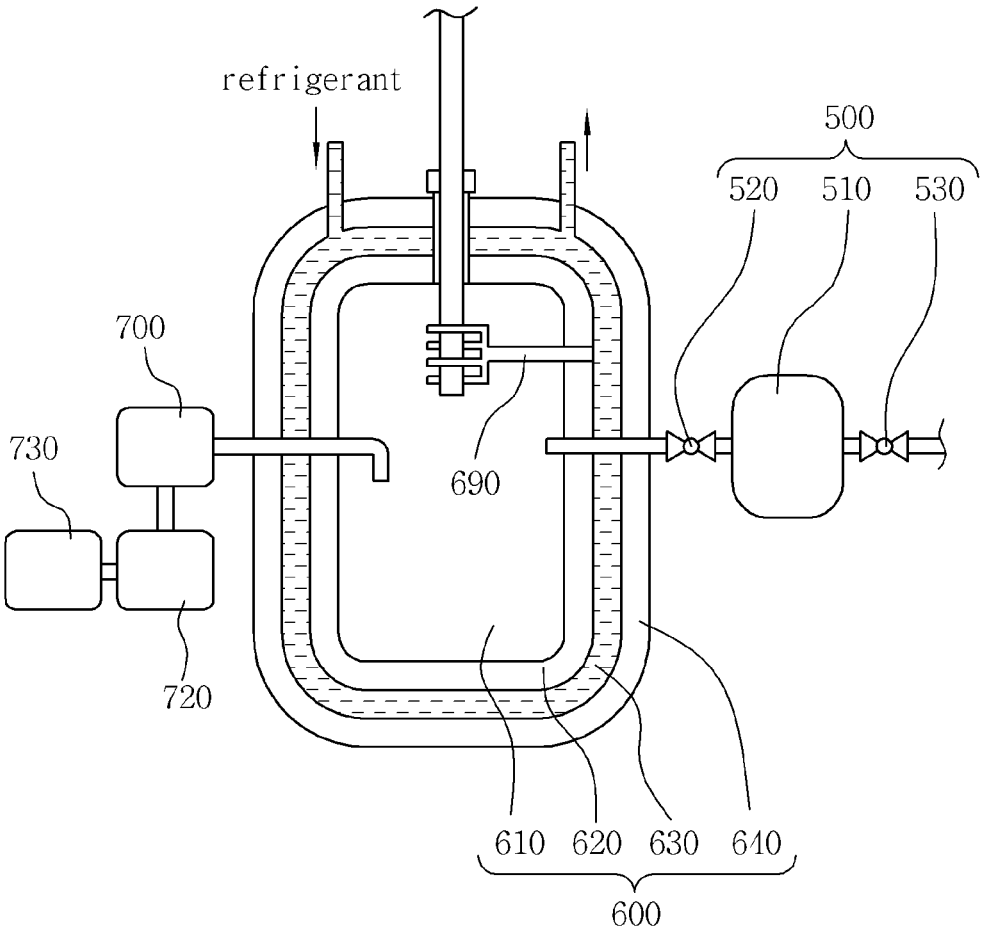
FIG. 11 is a view illustrating a transfer line and a contact-type precooler that are coupled to the dewar.

As shown in FIG. 4, the container-shaped dewar 600 is communicatively connected to the discharge valve 520 of the second NM compressor 500, and provides a storage space for storing the recycling gas in a liquid state. As shown in FIG. 11, the dewar 600 is connected to a transfer line 680 described hereinbelow by being provided with an opening 600*a*, thereby supplying the stored recycling gas in a liquid state to a cooling apparatus, which is not shown in the drawings.

As shown in FIG. 4, the cold finger 710 is provided in the storage space of the dewar 600 by protruding, wherein the cold finger is cooled by the refrigerator 700, and liquefies the recycling gas as the cold finger in a cryogenic state comes into contact with the recycling gas.

The compressor 720 supplies the refrigerator 700 with the refrigerant; and the chiller 730 cools the compressor 720.

In other words, the recycling gas in the adiabatic state is supplied to the dewar 600 by the adiabatic collector 10, and is changed into the liquid state through a phase change by coming into contact with the cold finger 710, thereby saving energy required for operating the refrigerator 700 or the compressor 720.

Figure 5:
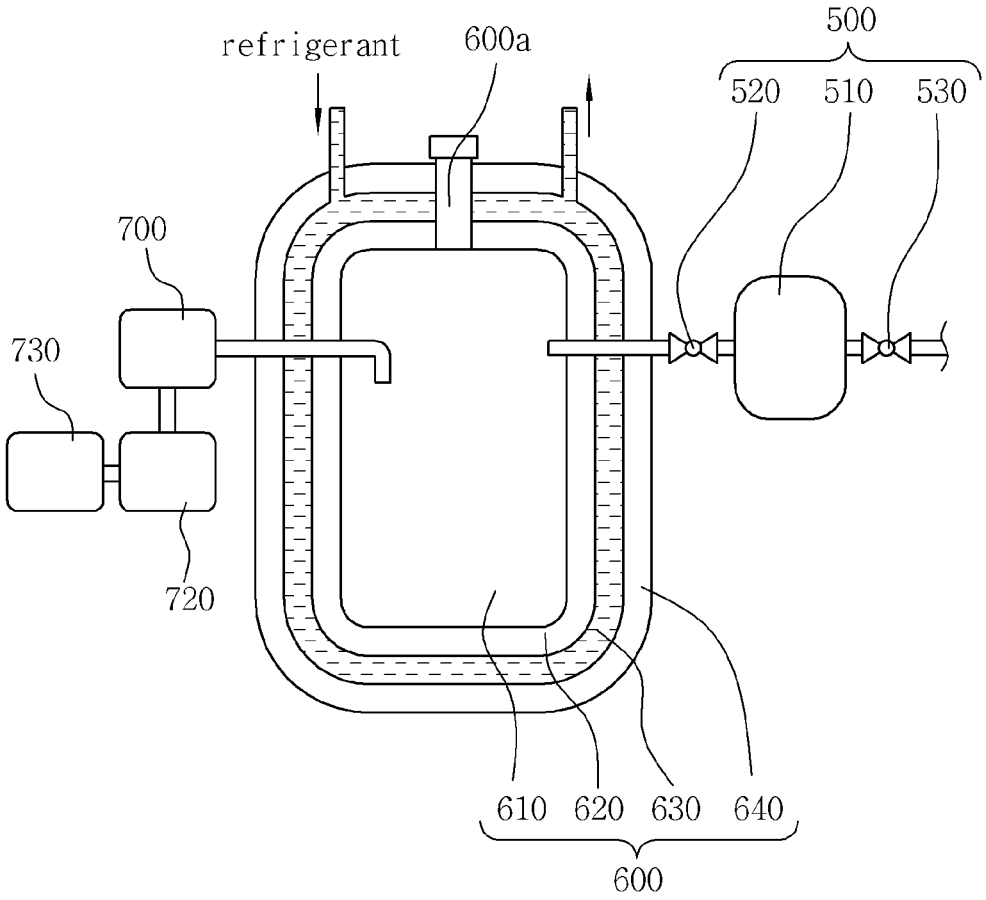
FIG. 5 is a sectional view illustrating a dewar according to an embodiment of the present invention of the liquefier shown in FIG. 4.

Meanwhile, as shown in FIG. 5, the dewar 600 may include: a liquefying tank 610 forming the storage space; a first vacuum jacket 620 forming a vacuum space along an outer surface of the liquefying tank 610; a refrigerant jacket 630 forming a cooling space along an outer surface of the first vacuum jacket 620; and a second vacuum jacket 640 forming a vacuum space along an outer surface of the refrigerant jacket 630 so as to prevent heat loss of the refrigerant jacket 630.

In other words, the dewar 600 is configured to have the same configuration as the adiabatic gas container 300, which is described hereinbefore, thereby cooling the liquefying tank 610 via the refrigerant jacket 630, insulating storage space the via the vacuum jackets 620 and 640, and thus keeping the recycling gas in an adiabatic state.

Figure 6:
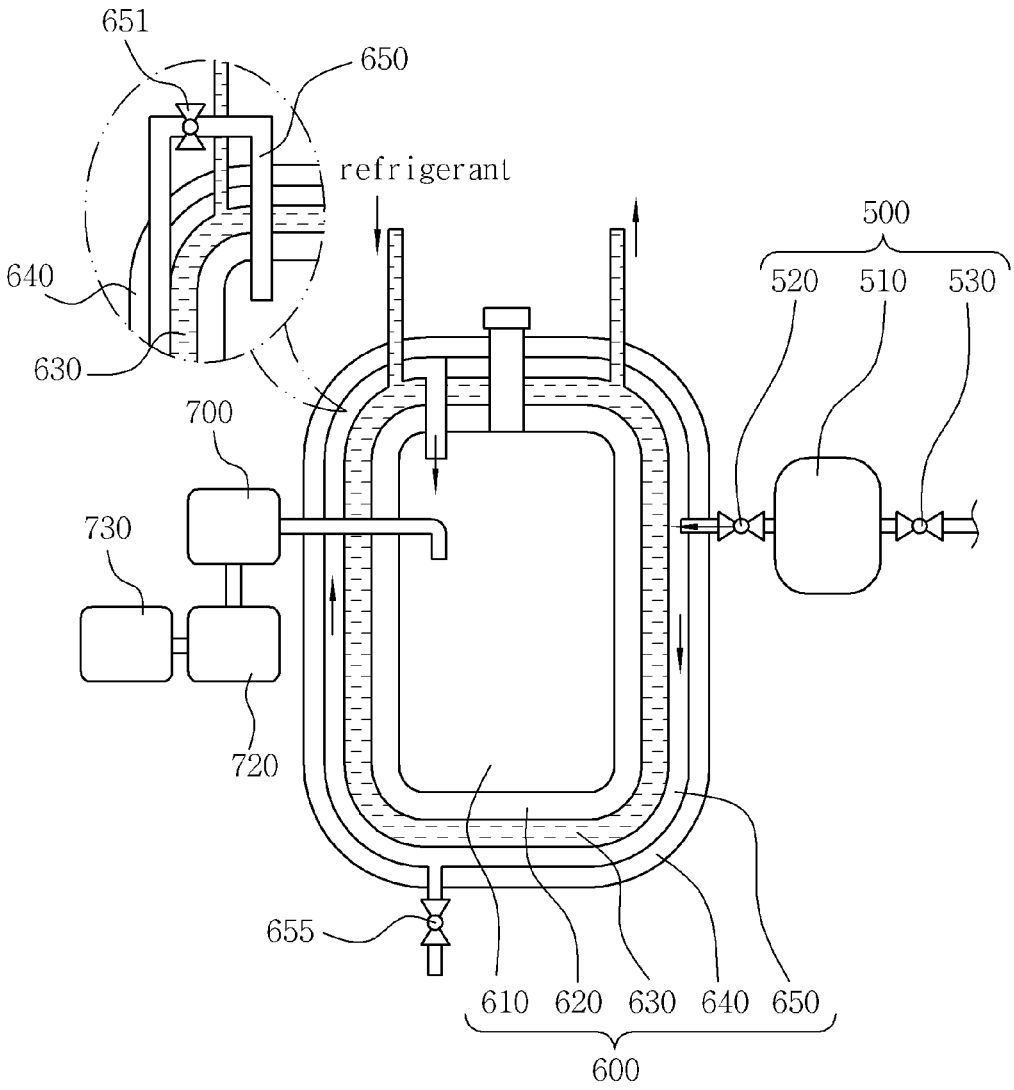
FIG. 6 is a sectional view illustrating the dewar according to another embodiment of the present invention.

Meanwhile, as shown in FIG. 6, the dewar 600 may further include a purification jacket 650.

The purification jacket 650, as shown in FIG. 6, detours the recycling gas supplied from the second NM compressor 500 along the outer surface of the refrigerant jacket 630 by forming a flow passage, through which the recycling gas flows, between the refrigerant jacket 630 and the second vacuum jacket 640.

The purification jacket 650 pre-cools the recycling gas by detouring the recycling gas in a state where the recycling gas comes into contact with the outer surface of the refrigerant jacket 630, and condenses and separates impurities in the recycling gas.

In other words, gas that has a higher dew point than that of the refrigerant flowing through the refrigerant jacket 630 is condensed and collected in a lower portion of the purification jacket 650 while flowing therethrough.

Herein, as shown in FIG. 6, the purification jacket 650 is provided with a drain valve 655 at a lower portion thereof so as to drain the collected impurities that are condensed to the outside.

Alternatively, when the drain valve 655 is not provided, the impurities may be discharged in a gas state by vaporization caused by a temperature rise of the purification jacket 650 when the refrigerant in the refrigerant jacket 630 is discharged after operating the dewar 600.

Meanwhile, as shown in an enlarged view of FIG. 6, the purification jacket 650 may be controlled by a control valve 651 by extending outside the second vacuum jacket 640.

Figure 7:
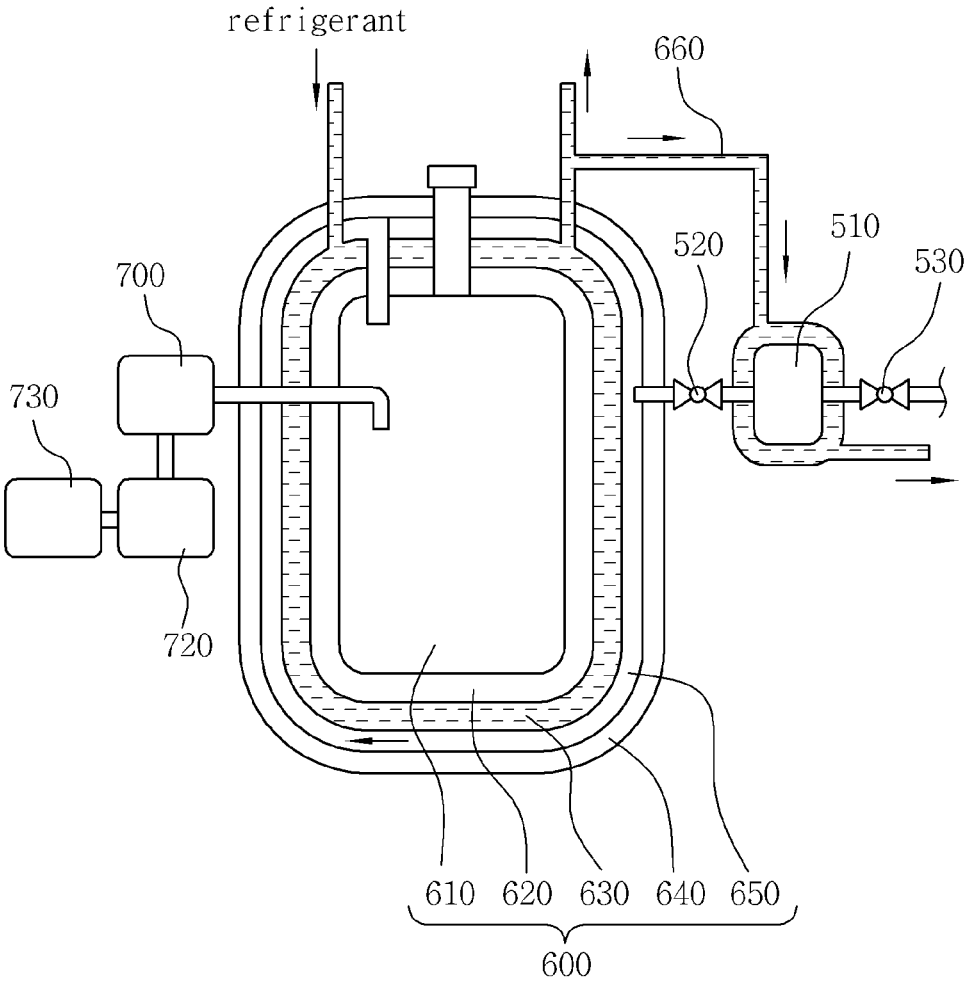
FIG. 7 is a sectional view illustrating the dewar according to a further embodiment of the present invention.

Further, as shown in FIG. 7, the dewar 600 may further include a refrigerant supply line 660.

The refrigerant supply line 660, as shown in FIG. 7, serves to cool the expansion chamber 510 to a low temperature by supplying the refrigerant discharged from the refrigerant jacket 630 along an outer surface of the expansion chamber 510 of the second NM compressor 500.

In other words, a state of the expansion chamber 510, as described above, is changed into a low temperature and low pressure state while the high temperature and high pressure recycling gas is discharged via the discharge valve 520, thereby allowing the recycling gas to flow therein via the inflow valve 530 through a natural inducement method by the pressure difference. Here, as the state of the expansion chamber 510 is changed into the low temperature and low pressure state, the expansion chamber is cooled by the refrigerant supplied from the refrigerant supply line 660, whereby the state of the expansion chamber is changed into the lower temperature and lower pressure state. Thus, a difference in temperature and pressure of the expansion chamber 510 is much larger, thereby allowing achieving high compression ratio.

Figure 8:
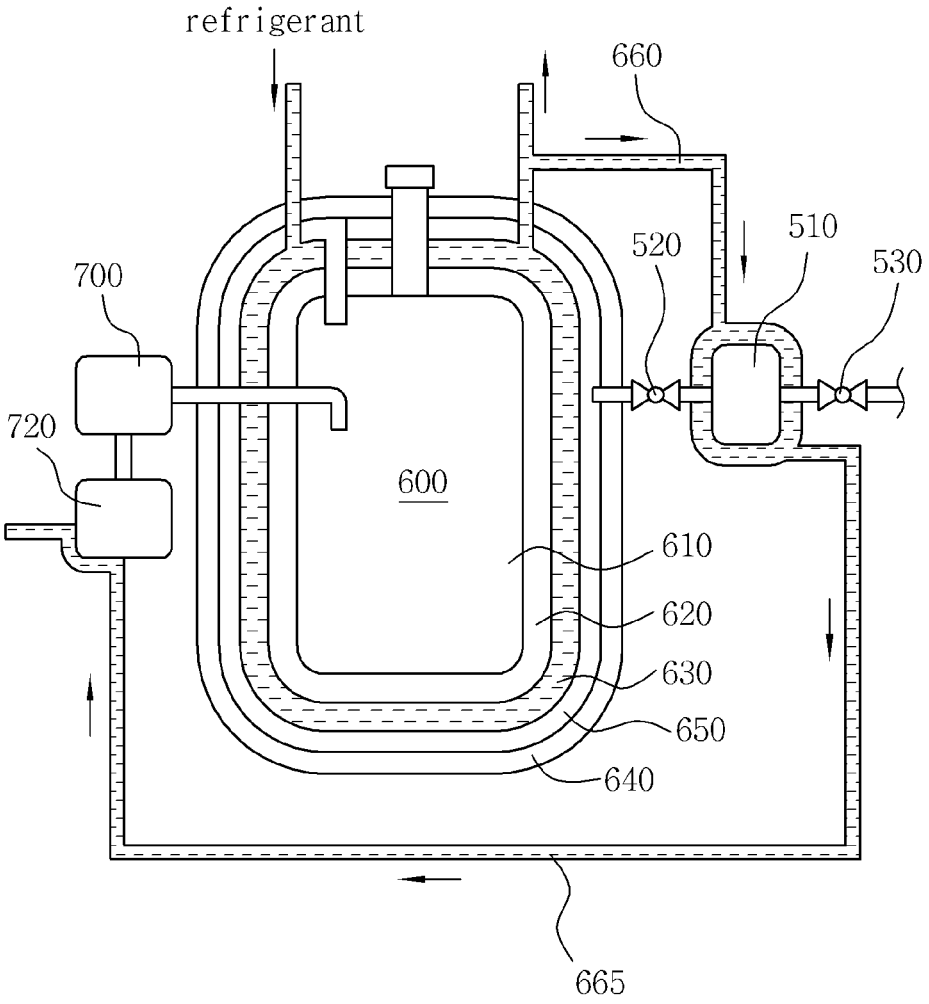
FIG. 8 is a sectional view illustrating the dewar according to a still another embodiment of the present invention.

Further, as shown in FIG. 8, the dewar 600 may further include a compressor cooling line 665.

The compressor cooling line 665 serves to cool the compressor 720 by supplying the compressor 720 with the refrigerant that is discharged from the refrigerant supply line 660 after cooling the expansion chamber 510.

In other words, the compressor cooling line 665 cools the compressor 720 by using the residual cold of the refrigerant after the refrigerant cools the expansion chamber 510.

As described above, in the case where the compressor 720 is cooled by the compressor cooling line 665, the chiller 730 may not be required, whereby it is possible to save energy required for operating the chiller 730.

Figure 9:
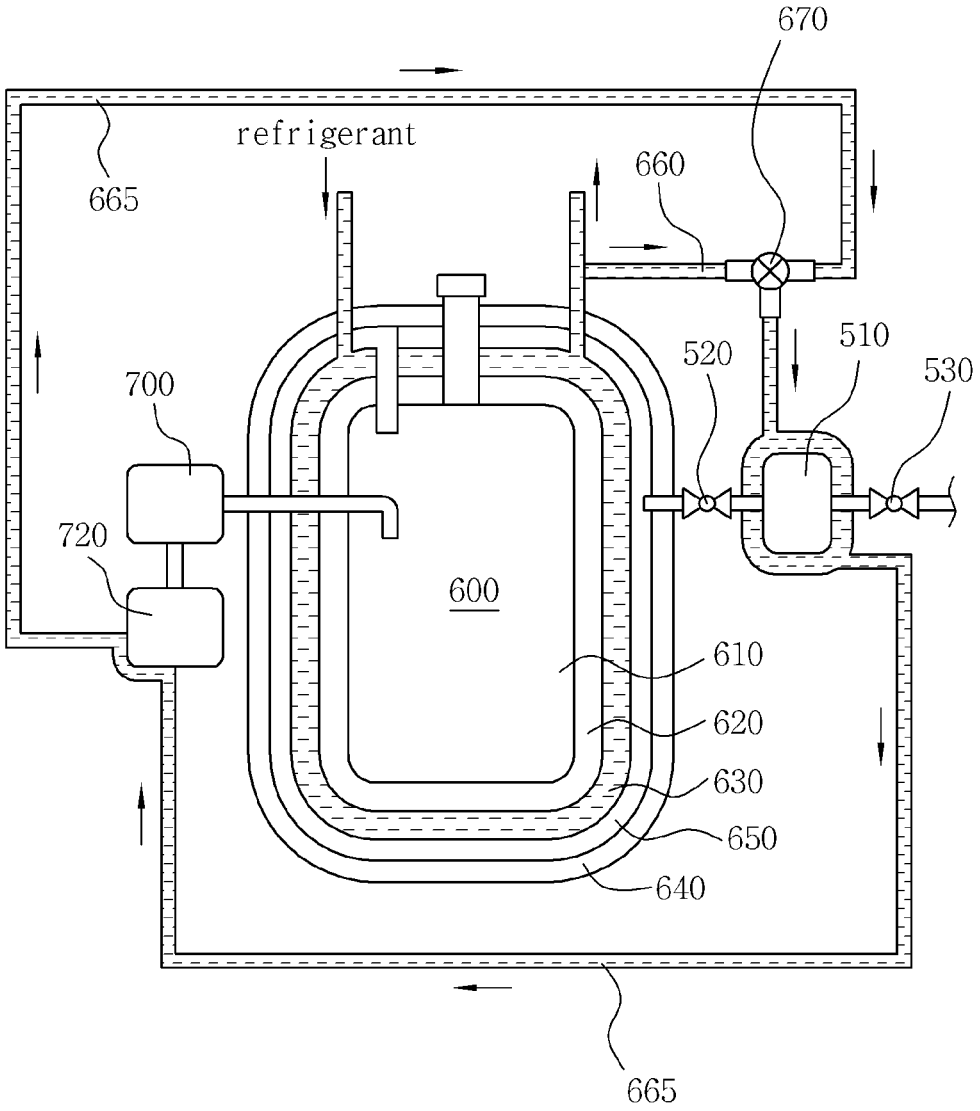
FIG. 9 is a view illustrating a configuration of a selector of the dewar.

Further, as shown in FIG. 9, the dewar 600 may further include a selector 670.

As shown in FIG. 9, the selector 670 is provided in the refrigerant supply line 660 and connected to the compressor supply line 665. The selector 670 cools the expansion chamber 510 by supplying the low temperature refrigerant discharged from the refrigerant jacket 630 to the expansion chamber 510; or the selector 670 heats the expansion chamber 510 by supplying the high temperature refrigerant discharged from the compressor cooling line 665 to the expansion chamber 510.

As shown in FIG. 9, the selector 670 may include a three-way valve, which communicates with the expansion chamber 510, and is connected to both the refrigerant supply line 660 and the compressor cooling line 665, whereby the three-way valve alternately communicates the expansion chamber with the refrigerant supply line 660 and with the compressor cooling line 665.

Figure 10A:
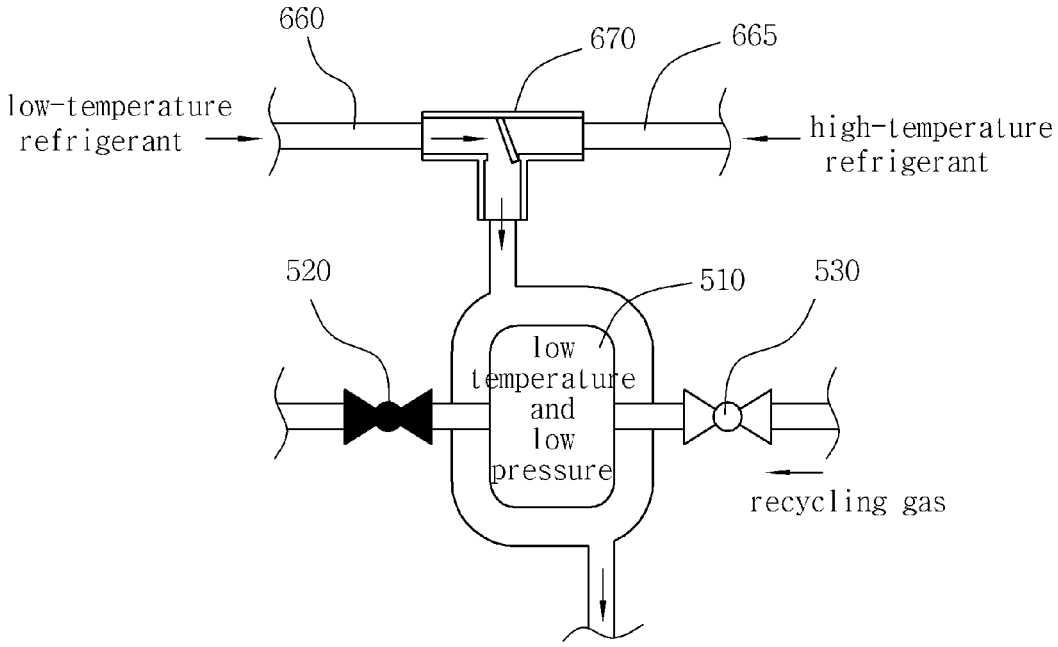
FIGS. 10*a* and 10*b* are views illustrating the selector and a second NM compressor shown in FIG. 9.

To be more specific, as shown in FIG. 10*a*, the selector 670 cools the expansion chamber 500 using the low temperature refrigerant by communicating refrigerant supply line 660 with the outer surface of the expansion chamber 510. Here, the state of the expansion chamber 510 is changed into the low temperature and low pressure state, thereby allowing the recycling gas to flow therein through the inflow valve 530.

Figure 10B:
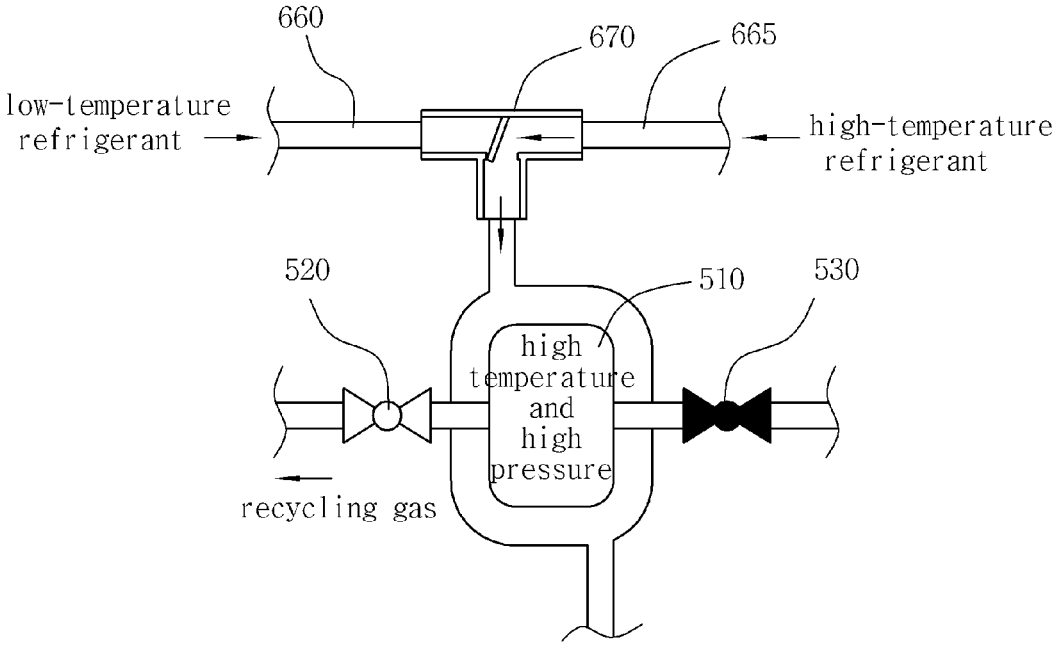

Further, as shown in FIG. 10*b*, the selector 670 heats the expansion chamber 510 using the high temperature refrigerant by communicating the compressor cooling line 665 with the outer surface of the expansion chamber 510. Here, the state of the expansion chamber 510 is changed into the high temperature and high pressure state, thereby discharging the recycling gas through the discharge valve 520.

Thereby, the expansion chamber 510 may not require the heater for heating the recycling gas, thereby saving energy and reducing equipment. Further, it is possible to supply the recycling gas compressed at a high compression ratio by repetitively cooling and heating the recycling gas.

Meanwhile, as shown in FIG. 11, the dewar 600 may further include: the transfer line 680 inserted into the storage space of the liquefying tank 610 via the opening 600*a* so as to discharge the recycling gas in the liquid state to the outside; and a contact-type precooler 690 pre-cooling the transfer line 680.

Herein, the transfer line 680 has a high temperature by being connected to the outside. Thereby, when the transfer line is inserted into the liquefying tank 610, recycling gas loss may occur through the vaporization thereof in the liquid state.

As shown in FIG. 11, the contact-type precooler 690 is in contact with the refrigerant jacket 630 at a first end thereof, and is in contact with the transfer line 680 at a second end thereof by protruding in the storage space of the liquefying tank 610, thereby pre-cooling the transfer line 680 by using cold of the refrigerant jacket 630.

The contact-type precooler 690, as shown in FIG. 11, formed to be in a brush shape at the second end thereof, and it is preferred that the second end is in contact with the transfer line 680 by being inserted thereinto.

As described above, the liquefier 20 according to the present invention is supplied with the recycling gas in the adiabatic state and stores the recycling gas in the adiabatic manner via the dewar 600, thereby preventing the heat loss of the recycling gas. Thus, it is possible to save energy required for liquefying the recycling gas. Further, the liquefier 20 compresses the recycling gas through a natural inducement method using the pressure difference and then supplies the recycling gas, thereby reducing noise, vibration, and the volume of equipment.

Figure 12:
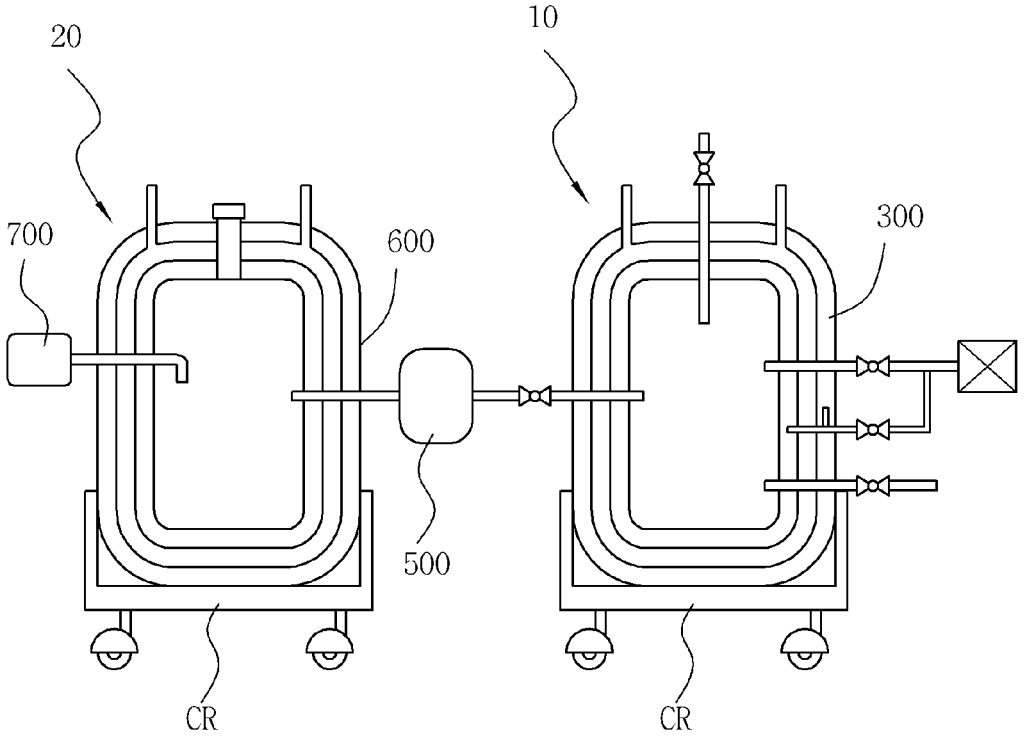
FIG. 12 is a conceptual view illustrating a movable recovery apparatus according to the present invention.

Meanwhile, as shown in FIG. 12, the adiabatic collector 10 and the liquefier 20 according to the present invention may be configured to be individually carried by being mounted to respective movable carriers CR, and to be detachably connected to each other.

In other words, the adiabatic collector 10 may be configured to collect the recycling gas by being connected to the recycling gas-generation line while being individually carried when necessary; the liquefier 20 may be configured to liquefy the recycling gas by being detachably connected to the discharge valve 312 of the adiabatic collector 10 via the second NM compressor 500 while being individually carried when necessary.

The adiabatic collector 10 for recycling gas, the liquefier 20 for recycling gas, and the recovery apparatus for recycling gas using the same according to the present invention, are configured such that the recycling gas is collected in an adiabatic manner by the adiabatic collector 10, is supplied to the liquefier 20, and is liquefied, thereby preventing a temperature rise of the recycling gas, thus minimizing energy consumption.

Further, the present invention is configured such that the compressors 200 and 500 that compress the recycling gas for collecting and liquefying the recycling gas are a non-mechanical type that compresses the recycling gas through a natural inducement method. Thus, it is possible to prevent vibration and noise, and is possible to miniaturize equipment, thereby making it possible to produce system in various shapes and sizes.

Further, the adiabatic collector 10 and the liquefier 20 may be configured to be individually carried by being mounted to respective movable carriers CR, and to be detachably connected to each other, whereby the transfer line provided in the conventional system may not be required. Thus, it is possible to reduce equipment costs.

Although a preferred embodiment of the present invention has been described for illustrative purposes, those skilled in the art will appreciate that various modifications, additions and substitutions are possible, without departing from the scope and spirit of the invention as disclosed in the accompanying claims.

INDUSTRIAL APPLICABILITY

The present invention is capable of improving reliability and competitiveness not only in the field of measuring instruments using cryogenic refrigerant, such as a nuclear magnetic resonance apparatus, a mass spectrometer, or an electron microscope, but also in the similar or related fields.

The invention claimed is:

1. A liquefier for recycling gas, the liquefier comprising:

a non-mechanical (NM) compressor which when supplied with recycling gas in an adiabatic state, non-mechanically compresses the recycling gas by using a pressure difference caused by thermal expansion of the recycling gas, and then supplies the recycling gas in a liquid state;

a dewar in fluid communication with the NM compressor, providing a storage space for storing the recycling gas in the liquid state, and having an opening provided at a side of the dewar so as to discharge the recycling gas in the liquid state through the opening;

a cold finger protruding into the storage space after penetrating the dewar for liquefying the recycling gas by coming into contact with the recycling gas supplied from the NM compressor in a cryogenic state;

a refrigerator for cooling the cold finger into a cryogenic state;

a compressor for supplying refrigerant to the refrigerator; and a chiller for cooling the compressor, wherein, the NM compressor includes:

an expansion chamber supplied with the recycling gas in the adiabatic state, changing the supplied recycling gas into high pressure recycling gas by supplying thermal energy thereto, and providing an expansion space for the recycling gas, a discharge valve in fluid communication with the expansion chamber and the dewar, and via which the high pressure recycling gas can be discharged into the dewar using a pressure difference between the recycling gas in the expansion chamber and the recycling gas in the dewar, an inflow valve in fluid communication with an inlet of the expansion chamber and a buffer container so as to allow the recycling gas to flow into the expansion chamber from the buffer container under influence of a pressure differential between the buffer container and the expansion chamber a liquefying tank forming the storage space;

a first vacuum jacket forming a vacuum space along an outer surface of the liquefying tank so as to prevent heat loss from the liquefying tank;

a refrigerant jacket forming a cooling space along an outer surface of the first vacuum jacket in which space the refrigerant can flow; and a second vacuum jacket forming a vacuum space along an outer surface of the refrigerant jacket so as to prevent heat loss from the refrigerant jacket;

a purification jacket between the refrigerant jacket and the second vacuum jacket, the purification jacket having a first end in fluid communication with the discharge valve of the NM compressor and a second end in fluid communication with the liquefying tank, the purification jacket configured to effect a pre-cooling of the recycling gas by using coldness of the refrigerant jacket by routing the recycling gas from the NM compressor along the outer surface of the refrigerant jacket and to condense impurities in the recycling gas.

2. The liquefier for recycling gas of claim 1, wherein the dewar further includes:

a drain valve provided at a lower portion of the purification jacket so as to drain the impurities condensed by the cold of the refrigerant jacket.

3. The liquefier for recycling gas of claim 1, wherein the dewar further includes:

a refrigerant supply line for cooling the expansion chamber to a low temperature by supplying a part of the refrigerant flowing out from the refrigerant jacket in a state of being processed by heat exchange between the refrigerant and the recycling gas flowing through the purification jacket, along an outer surface of the expansion chamber of the NM compressor.

4. The liquefier for recycling gas of claim 3, wherein the dewar further includes:

a compressor cooling line for cooling the compressor by using the refrigerant by supplying the refrigerant discharged from the refrigerant supply line after cooling the expansion chamber, to the compressor.

5. The liquefier for recycling gas of claim 4, wherein the dewar further includes:

a selector provided in the refrigerant supply line, wherein the selector supplies the refrigerant at a low temperature discharged from the refrigerant jacket to the expansion chamber or supplies the refrigerant at a high temperature discharged from the compressor cooling line to the expansion chamber.

6. The liquefier for recycling gas of claim 5, wherein the selector includes:

a three-way valve openably provided in the refrigerant supply line, wherein the three-way valve cools the expansion chamber by communicating the refrigerant jacket with the outer surface of the expansion chamber, or heats the expansion chamber by communicating the compressor cooling line with the outer surface of the expansion chamber.

7. The liquefier for recycling gas of claim 1, wherein the dewar further includes:

a transfer line inserted into the storage space of the liquefying tank through the opening and discharging the recycling gas in the liquid state stored in the liquefying tank to outside; and a precooler which is in contact with the refrigerant jacket at a first end thereof, and which is in contact with the transfer line at a second end thereof by protruding in the storage space, thereby pre-cooling the transfer line by using cold of the refrigerant jacket.

* * * * *